US006638175B2

(12) United States Patent
Lee et al.

(10) Patent No.: US 6,638,175 B2
(45) Date of Patent: Oct. 28, 2003

(54) DIAGNOSTIC GOLF CLUB SYSTEM

(75) Inventors: Nathan J. Lee, Escondido, CA (US); Aaron Linsdau, San Diego, CA (US); Jan N. Houshar, Santee, CA (US); Nigel Simmons, Abington (GB); Peter Matthewson, Chelmsford (GB); Ian Ansell, Newmarket (GB)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/892,141

(22) Filed: Jun. 25, 2001

(65) Prior Publication Data

US 2002/0107085 A1 Aug. 8, 2002

Related U.S. Application Data

(63) Continuation-in-part of application No. 09/753,264, filed on Dec. 29, 2000, now Pat. No. 6,402,634, which is a continuation of application No. 09/310,835, filed on May 12, 1999, now Pat. No. 6,224,493.

(51) Int. Cl.[7] ..... A63B 69/36

(52) U.S. Cl. ..... 473/223; 473/221; 473/226; 473/233

(58) Field of Search ..... 473/131, 198, 473/201–202, 219, 221–226, 231–233, 407, 409

(56) References Cited

U.S. PATENT DOCUMENTS

| | | | | |
|---|---|---|---|---|
| 1,876,657 A | | 5/1932 | Fox | |
| 3,182,508 A | | 5/1965 | Varju | |
| 3,270,564 A | | 9/1966 | Evans | |
| 3,717,875 A | | 2/1973 | Evans | |
| 3,788,647 A | | 1/1974 | Evans | |
| 3,792,863 A | | 2/1974 | Evans | |
| 3,806,131 A | | 4/1974 | Evans | |
| 3,818,341 A | * | 6/1974 | Burdick | 324/163 |
| 3,945,646 A | | 3/1976 | Hammond | |
| 4,088,324 A | | 5/1978 | Farmer | |
| 4,136,387 A | | 1/1979 | Sullivan et al. | |
| 4,138,118 A | * | 2/1979 | Budney | 473/202 |
| 4,239,227 A | * | 12/1980 | Davis | 473/220 |
| 4,684,133 A | * | 8/1987 | Maroth | 473/233 |
| 4,759,219 A | | 7/1988 | Cobb et al. | |
| 4,789,160 A | | 12/1988 | Dollar, Jr. et al. | |
| 4,822,042 A | | 4/1989 | Landsman | |
| 4,830,377 A | | 5/1989 | Kobayashi | |
| 4,834,376 A | | 5/1989 | Steinberg | |
| 4,861,034 A | * | 8/1989 | Lee | 273/DIG. 30 |
| 4,870,868 A | | 10/1989 | Gastgeb et al. | |
| 4,898,389 A | | 2/1990 | Plutt | |
| 4,930,787 A | | 6/1990 | Nobles, Jr. | |
| 4,940,236 A | | 7/1990 | Allen | |
| 4,991,850 A | | 2/1991 | Wilhelm | |
| 5,031,909 A | | 7/1991 | Pecker | |
| 5,111,410 A | | 5/1992 | Nakayama et al. | |
| 5,131,660 A | | 7/1992 | Marocco | |
| 5,184,826 A | | 2/1993 | Hall, Jr. | |
| 5,209,483 A | | 5/1993 | Gedney et al. | |
| 5,221,088 A | | 6/1993 | McTeigue et al. | |
| 5,233,544 A | | 8/1993 | Kobayashi | |

(List continued on next page.)

*Primary Examiner*—Michael O'Neill
*Assistant Examiner*—Scott E. Jones
(74) *Attorney, Agent, or Firm*—Michael A. Catania; Elaine H. Lo

(57) ABSTRACT

A diagnostic golf club system having a diagnostic golf club, an interface means and a computing means is disclosed herein. The diagnostic golf club includes a plurality of strain gauges, an internal power supply, and a non-volatile memory for capturing data relating to a golf swing. The interface means is capable of transferring data from the diagnostic golf club to the computing means for processing the data and presenting the data in a useful and informative format. The data may be used to determine a shaft flex profile for a particular golfer.

17 Claims, 10 Drawing Sheets

U.S. PATENT DOCUMENTS 5,303,925 A * 4/1994 Rawson ..... 473/233
5,322,289 A * 6/1994 Abrams et al. ..... 473/202
5,332,225 A 7/1994 Ura
5,377,541 A * 1/1995 Patten ..... 473/202
5,395,116 A 3/1995 Blaakman
5,419,563 A 5/1995 Abrams et al.
5,435,561 A 7/1995 Conley
5,441,256 A * 8/1995 Hackman ..... 473/233
5,441,269 A 8/1995 Henwood
5,447,311 A 9/1995 Viollaz et al.
5,472,205 A 12/1995 Bouton
5,474,298 A 12/1995 Lindsay
5,482,283 A 1/1996 Wall
5,492,329 A 2/1996 Kronin
5,616,832 A 4/1997 Nauck
5,623,459 A 4/1997 Iwamura et al.
5,638,300 A 6/1997 Johnson
5,688,183 A 11/1997 Sabatino et al.
5,694,340 A 12/1997 Kim
5,707,298 A 1/1998 Chovanes
5,709,610 A 1/1998 Ognjanovic
5,779,555 A 7/1998 Nomura et al.
5,792,000 A 8/1998 Weber et al.
5,792,001 A 8/1998 Henwood
5,916,040 A 6/1999 Umazume
6,079,612 A 6/2000 Tung
6,213,888 B1 * 4/2001 Kawaguchi et al. ..... 473/223
6,231,453 B1 * 5/2001 Jebe ..... 473/233
6,441,745 B1 * 8/2002 Gates ..... 340/669

* cited by examiner $$\begin{bmatrix} Px \\ Vy \\ Vz \\ My \\ Mz \\ Tx \end{bmatrix} = \begin{bmatrix} EA/3 & EA/3 & EA/3 & 0 & 0 & 0 \\ 0 & 0 & 0 & KAG/sqrt3 & -KAG/sqrt3 & 0 \\ 0 & 0 & 0 & -KAG3 & -KAG3 & 2*KAG/3 \\ EI/(Ro*sqrt(3)) & EI/(Ro*sqrt(3)) & 0 & 0 & 0 & 0 \\ -EI/Ro & -EI/Ro & -2*EI/Ro & 0 & 0 & 0 \\ 0 & 0 & 0 & GJ(3*Ro) & GJ(3*Ro) & GJ(3*Ro) \end{bmatrix} X \begin{bmatrix} e1 \\ e2 \\ e3 \\ g1 \\ g2 \\ g3 \end{bmatrix}$$

CALLAWAY GOLF COMPANY
OBD II EXPORTED DATA FILE
CLUB ID

8 DEGREE HAWK EYE DRIVER
WITH L STRONG SHAFT
OBD 11 # 7
SAMPLE RATE = 100/S/CH.

TIP
EA: 887000
EI : 9510
GJ: 2630
KAG: 65300
Ro: 0.175

| TIME | BUTT e1 s=0 c=0 | BUTT e2 s=0 c=1 | BUTT e3 s=0 c=2 | BUTT g1 s=0 c=3 | BUTT g2 s=0 c=4 | BUTT g3 s=0 c=5 | TIP e1 s=0 c=6 | TIP e2 s=0 c=7 | TIP e3 s=0 c=8 | TIP g1 s=0 c=9 | TIP g2 s=0 c=10 | TIP g3 s=0 c=11 | STRESS RESULTANTS AT BUTT Px | Vy | Vz | My | Mx | Tx | STRESS RESULTANTS AT TIP Px | Vy | Vz | My | Mx | Tx |
|---|---|---|---|---|---|---|---|---|---|---|---|---|---|---|---|---|---|---|---|---|---|---|---|---|
| 0 | 60.201 | 49.823 | -117.47 | 18.749 | -23.924 | -16.503 | 79.184 | 118.09 | 111.2 | -21.783 | -27.952 | -30.843 | -1.807116 | -1.99806 | -0.75236 | -0.6092246 | -35.4286 | -0.28181 | 91.20548 | -0.30381 | -0.33961 | 1.22067 | 1.365419 | -0.40368 |
| 0.01 | 69.99 | 93.872 | -137.04 | 14.843 | -26.783 | -38.962 | 65.413 | 104.32 | 152.52 | -8.2891 | -8.6747 | -17.349 | 6.822812 | -2.08953 | -1.70267 | 1.4215241 | -44.9723 | -0.70073 | 95.27947 | -0.01899 | -0.50424 | 1.220702 | 7.352969 | -0.17189 |
| 0.02 | 84.673 | 74.395 | -92.994 | 22.655 | -14.159 | -22.362 | 86.07 | 66.446 | -2.41 | -10.217 | -20.241 | -3.8554 | 16.254204 | -1.72375 | -1.43871 | -0.6092246 | -35.4257 | -0.18026 | 44.38134 | -0.48356 | 0.846779 | -0.5157 | -8.55009 | -0.17189 |
| 0.03 | 65.096 | 103.76 | -127.25 | 22.655 | -16.112 | -27.244 | 37.871 | 32.018 | 14.804 | -17.928 | -8.6747 | -15.422 | 10.235078 | -1.81519 | -1.64987 | 2.2917942 | -43.4845 | -0.26911 | 25.0409 | 0.455706 | -0.12059 | -0.18364 | -2.18898 | -0.21052 |
| 0.04 | 74.884 | 54.817 | -117.47 | 19.725 | -14.159 | -22.362 | 27.542 | 49.232 | 14.804 | -8.2891 | -14.458 | 3.8554 | 3.008826 | -1.58655 | -1.35951 | -1.189484 | -37.4365 | -0.21835 | 27.07656 | -0.30381 | 0.88802 | 0.680521 | -2.58314 | -0.09484 |
| 0.05 | 114.04 | 89.078 | -151.52 | 23.631 | -12.206 | -21.365 | 79.184 | 32.018 | 1.0328 | -18 | -22.169 | -3.8554 | 10.233108 | -1.678 | -1.46507 | -1.4796133 | -54.0189 | -0.12948 | 33.18409 | -0.30381 | 0.656028 | -1.47963 | -5.93078 | -0.21052 |
| 0.06 | 65.096 | 113.55 | -141.94 | 25.584 | -20.965 | -14.56 | 86.856 | 93.988 | -23.067 | -6.3614 | -14.458 | -11.566 | 9.029678 | -2.18097 | -0.91073 | 2.6720928 | -47.488 | -0.12949 | 41.3274 | -0.39874 | -0.08675 | 0.788513 | -11.3585 | -0.16224 |
| 0.07 | 94.462 | 103.78 | -132.15 | 23.631 | -6.3473 | -16.503 | 89.841 | 38.904 | 7.9184 | 5.2048 | 12.63 | -1.53E-05 | 16.253712 | -1.40368 | -1.3595 | 0.5511355 | -47.4856 | 0.010149 | 43.36348 | 0.360751 | -0.50428 | -1.91189 | -6.67918 | 0.088843 |
| 0.08 | 69.99 | 79.289 | -151.52 | 18.749 | -25.977 | -21.365 | 27.542 | 45.789 | 35.461 | 9.0602 | -14.458 | -19.277 | -3.011286 | -2.08953 | -0.96352 | 0.5511948 | -48.4914 | -0.37087 | 32.18617 | -1.15822 | -0.94274 | 0.572497 | -0.13091 | -0.12361 |
| 0.09 | 123.83 | 89.078 | -127.25 | 30.467 | -16.112 | -28.221 | 27.542 | 93.988 | 28.575 | -14.072 | -16.365 | -1.53E-05 | 21.071668 | -2.18097 | -1.91388 | -2.0599119 | -47.9872 | -0.18026 | 44.38105 | -0.11391 | 0.865993 | 2.084734 | -3.49859 | -0.15258 |
| 0.1 | 74.884 | 79.289 | -151.52 | 25.584 | -13.183 | -9.6673 | 27.542 | 59.56 | 18.247 | -4.4337 | -12.53 | -28.06 | -1.807362 | -1.81519 | -0.85792 | 0.2611047 | -48.9939 | 0.035538 | 31.14819 | -0.39873 | -0.94274 | 1.00458 | -2.75018 | -0.21052 |
| 0.11 | 94.462 | 108.66 | -168.41 | 34.373 | -16.112 | -30.174 | 30.965 | 100.87 | 18.247 | -0.5783 | 4.8192 | -11.566 | 8.031152 | -2.36386 | -2.12506 | 0.8415612 | -56.0234 | -0.15487 | 44.38016 | 0.265816 | -0.7783 | 2.192832 | -5.18219 | -0.0387 |
| 0.12 | 123.83 | 74.395 | -148.83 | 20.702 | -14.159 | -16.456 | 37.871 | 32.018 | 21.89 | -0.5783 | 6.7469 | 11.566 | 12.84317 | -1.6323 | -1.17473 | -2.9302412 | -60.5002 | -0.15487 | 27.07656 | 0.360751 | 0.482328 | -0.18364 | -1.44057 | 0.088842 |
| 0.13 | 114.04 | 123.34 | -168.41 | 34.373 | -9.2766 | -21.365 | 72.299 | 90.546 | 18.247 | -14.072 | -8.6747 | 3.8554 | 17.45862 | -2.04382 | -1.83465 | 0.551254 | -58.5405 | 0.048248 | 53.54287 | 0.265806 | 0.866008 | 0.572497 | -6.86527 | -0.09484 |
| 0.14 | 84.673 | 64.606 | -158.41 | 32.42 | -19.042 | -32.127 | 24.1 | 38.904 | -19.624 | -6.3614 | -16.365 | -28.988 | -4.214226 | -2.40961 | -2.09865 | -1.189484 | -49.4055 | -0.24374 | 12.82602 | -0.48364 | -0.89798 | 0.484473 | -5.55887 | -0.24918 |
| 0.15 | 153.19 | 69.5 | -161.52 | 22.655 | -14.159 | -9.6673 | 68.856 | 87.103 | 7.9184 | -18 | -16.365 | -19.277 | 15.04782 | -1.72375 | -0.75235 | -4.9806936 | -56.0283 | -0.01523 | 48.45308 | -0.01896 | -0.17541 | 0.572497 | -7.61464 | -0.2588 |
| 0.16 | 94.462 | 54.817 | -168.41 | 24.608 | -8.3003 | -12.597 | 65.413 | 73.332 | 18.247 | -8.2891 | -8.747 | -3.8554 | -4.214226 | -1.54087 | -1.12193 | -2.3499426 | -49.4965 | 0.048239 | 46.4173 | 0.075945 | 0.208283 | 0.248458 | -5.55861 | -0.09484 |
| 0.17 | 60.201 | 89.078 | -148.83 | 38.328 | -6.3473 | -26.268 | 92.956 | 87.103 | -12.738 | 9.0602 | -14.458 | -23.132 | 0.602454 | -1.9981 | -2.23085 | 1.7118734 | -45.4751 | 0.048239 | 49.47124 | -1.15822 | -1.16198 | -0.18364 | -11.1594 | -0.14292 |
| 0.18 | 84.673 | 128.23 | -188.41 | 40.232 | -6.3473 | -20.409 | 86.07 | 63.003 | 21.89 | 5.2048 | -8.6747 | 3.8554 | 11.437278 | -2.18099 | -2.01946 | 2.681825 | -56.0278 | 0.175184 | 50.48893 | -0.68354 | 0.317905 | -0.72372 | -5.74386 | 0.001931 |
| 0.19 | 123.83 | 138.02 | -117.47 | 18.749 | -14.159 | -32.127 | 51.642 | 45.789 | 1.0328 | -8.2891 | 2.8915 | -15.422 | 35.51718 | -1.54085 | -1.88108 | 0.641107 | -51.0838 | -0.35798 | 29.11246 | 0.550622 | -0.72353 | -0.18364 | -5.18243 | -0.1043 |
| 0.2 | 84.673 | 93.972 | -188.41 | 21.678 | -24.801 | -13.573 | 37.871 | 32.018 | 21.89 | -0.5783 | -4.8193 | -25.06 | 3.00931 | -2.18097 | -0.64672 | 0.5511948 | -52.5104 | -0.21835 | 27.07656 | -0.20886 | -1.27161 | -0.18364 | -1.44057 | -0.15258 |
| 0.21 | 133.62 | 113.55 | -107.68 | 32.42 | -21.971 | -17.479 | 37.871 | 45.789 | -12.738 | 12.916 | -12.53 | 11.566 | 34.31454 | -2.54676 | -1.2275 | -1.1898418 | -47.4364 | -0.09139 | 20.96927 | -1.25316 | 0.645745 | 0.246426 | -5.93078 | 0.058874 |
| 0.22 | 74.884 | 54.817 | -107.68 | 12.89 | -27.63 | -24.315 | 92.956 | 128.42 | 138.74 | -14.072 | -31.807 | -25.06 | 5.417168 | -1.90684 | -0.91075 | -1.189484 | -35.4293 | -0.51032 | 106.4743 | -0.87341 | -0.12059 | 1.112878 | 3.048852 | -0.35837 |
| 0.23 | 94.462 | 96.687 | -146.83 | 18.749 | -23.924 | -39.939 | 96.398 | 114.65 | 97.431 | -21.783 | -12.53 | -23.132 | 11.438754 | -1.99808 | -2.01947 | 0.2611047 | -49.9975 | -0.56648 | 91.20896 | 0.455692 | -0.33981 | 0.572654 | -0.87959 | -0.26777 |
| 0.24 | 65.096 | 118.44 | -141.94 | 21.678 | -10.253 | -14.56 | 51.642 | 67.103 | 7.9184 | 12.916 | -8.6747 | -7.7108 | 10.232816 | -1.49511 | -1.09553 | 3.1619457 | -47.988 | -0.04083 | 43.36348 | -1.0833 | -0.55908 | 1.002584 | 6.67918 | -0.01738 |
| 0.25 | 123.83 | 152.71 | -87.888 | 36.326 | -14.159 | -12.597 | 68.856 | 69.889 | 11.361 | -4.4337 | 2.8915 | -7.7108 | 43.948392 | -2.36386 | -1.28033 | 1.7118512 | -48.4911 | -0.12441 | 44.38134 | 0.360751 | -0.39464 | 0.03241 | -5.30502 | -0.04835 |
| 0.26 | 94.462 | 74.395 | -171.3 | 14.843 | -21.971 | -18.456 | 44.756 | 25.132 | -12.738 | -4.4337 | -12.53 | -11.566 | -0.600978 | -1.72375 | -0.80516 | -1.189454 | -52.5095 | -0.33259 | 16.89735 | -0.39873 | -0.17539 | -0.6157 | -5.18235 | -0.14292 |
| 0.27 | 55.307 | 84.184 | -107.68 | 19.725 | -14.159 | -21.365 | 62.627 | 52.675 | 35.461 | -10.217 | 14.458 | 3.8554 | 7.825506 | -1.58655 | -1.30668 | 1.7115734 | -38.4314 | -0.20565 | 50.48893 | 1.215194 | 0.098658 | -0.93974 | 3.49859 | 0.040559 |
| 0.28 | 114.04 | 123.34 | -107.68 | 34.373 | -6.3473 | -1.6583 | 41.314 | 100.87 | -9.2956 | 12.916 | -8.6747 | -7.7108 | 31.9062 | -1.90685 | -0.85794 | 0.551254 | -48.4313 | 0.340215 | 39.29057 | -1.0833 | -0.55908 | 1.868561 | -8.73898 | -0.01738 |
| 0.29 | 55.307 | 113.55 | -141.94 | 42.185 | -13.183 | -11.62 | 68.856 | 83.003 | 1.0328 | -0.5783 | -0.96386 | -25.06 | 6.621562 | -2.5925 | -1.41228 | 3.4523321 | -46.481 | 0.225866 | 39.29156 | 0.01899 | -1.38123 | -0.18364 | -7.05334 | -0.13326 |

DIAGNOSTIC GOLF CLUB SYSTEM

CROSS REFERENCES TO RELATED APPLICATIONS

The present application is a continuation-in-part application of U.S. patent application Ser. No. 09/753,264, filed on Dec. 29, 2000 Now U.S. Pat. No. 6,402,634, which is a continuation application of U.S. patent application Ser. No. 09/310,835, filed on May 12, 1999, now U.S. Pat. No. 6,224,493, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to golf equipment and, more specifically, to a diagnostic golf club having the ability to make quantitative measurements of specific mechanical or physical properties of the golf club during a golf swing. Strain gauges are provided on the exterior of the shaft of the golf club and a memory device is provided within the interior containing data descriptive of the measured properties.

2. Description of the Related Art

Various data measuring and collecting devices and methods are used for analyzing a golf club during a golf swing. In a similar manner, the effectiveness of a golf ball impact with the golf club during the golf swing can be measured in terms of initial launch conditions. Such launch conditions include the initial velocity, launch angle, spin rate and spin axis of the golf ball. These launch conditions are determined principally by the velocity of a club head at impact and the loft and angle of a club face relative to the intended trajectory of the golf ball's flight. There are two general methods for analyzing the golf club during a golf swing: visual analysis and quantitative variable analysis.

The method of analyzing a golf club during a golf swing using visual analysis typically is conducted by a golf instructor capable of visually discerning golf swing variables, and suggesting corrections in the golfer's swing to provide improvement. However, not every golfer has ready access to professional golf instruction. The golfer also can diagnose certain swing faults using visual analysis methodology employing one or more cameras to record the golfer's swing and comparing it to a model swing. Using various camera angles and slow motion play back, the actual swing motion can be reviewed and altered in subsequent swings.

On the other hand, quantitative variable analysis employs sensors to directly measure various mechanical or physical properties of the golf club during the swing motion. Sensors, such as strain gauges or accelerometers, typically are attached to the shaft or the golf club head. Data collected from these strain gauges then may be transferred to a signal processor via wires or radio waves, and can be presented in various graphical formats, including graphical and tabular charts. A significant drawback associated with the use of wires in an instrumented golf club is that the wires can be very cumbersome, and can become obtrusive to the golfer when the golfer attempts to swing the golf club. Several different approaches to analyzing a golf club or baseball bat during a baseball or golf swing using quantitative variable analysis are discussed in the patents listed below.

For example, in U.S. Pat. No. 4,759,219, issued to Cobb et al., the specification discloses a baseball bat with a self-contained measuring device and display. A spring potentiometer is used to measure centrifugal force, and an LED or LCD displays the measured force. However, this bat does not contain any data storage capability.

U.S. Pat. No. 5,233,544, issued to Kobayashi, discloses a golf club having multiple sensors, and a cable for transmitting data to a computer for data processing. This arrangement can accommodate up to 5 sensors in a cartridge located in the handle region of the golf club.

U.S. Pat. No. 3,182,508, issued to Varju, discloses the use of a strain gauge in the bottom of a golf club, and a wire for connecting the sensor to a data processing means located separate from the golf club.

U.S. Pat. No. 5,694,340, issued to Kim, discloses the use of multiple sensors for measuring the acceleration of a golf club, and uses either a cable or radio transmissions to transfer data from the sensors to an external data processing means.

U.S. Pat. No. 4,991,850, issued to Wilhelm, discloses the use of a sensor for measuring the applied force of a golf swing. The sensor data can be displayed on a wrist-mounted arrangement or be downloaded to a computer via cable or radio transmission.

U.S. Pat. No. 3,792,863, issued to Evans, discloses the use of multiple sensors, including an accelerometer and strain gauges, to measure torque and flex. Data is transferred from the golf club to a data analysis station via FM radio signals, with each sensor having its own data transfer frequency.

Thus, data transfer to an external memory device is a significant drawback. The cumbersome nature of data transfer via cables or wires affects the motion and feel of a golfer's actual golf swing. In addition, while the use of radio transmissions is preferable to the use of wires or cables emanating from the golf club for transferring data, a transmitter adds excessive weight. The effective range of these wireless instrumented golf clubs is limited by the low power used in such embodiments, and the accuracy of the radio transmitted data is subject to interference or noise from other sources of nearby radio transmissions.

Furthermore, in conventional systems, the receiving equipment typically must be located in close proximity to the radio transmitter disposed in the golf club thereby restricting the flexibility and portability of using such systems. Thus, it is desirable to provide an instrumented golf club that approximates the weight, balance and feel of a golfer's own golf club, in order to ensure that the data collected from the instrumented golf club is applicable to the golfer's actual golf swing. It also may be desirable to provide additional sensors for measuring certain parameters of a golf swing that have previously not been available in instrumented golf clubs. It further may be desirable to provide an efficient means of memory storage within the instrumented golf club to enable internal data capture and storage until the user is ready to download the data for further processing. It further may be desirable to provide data from the instrumented golf club for golf club design.

BRIEF SUMMARY OF THE INVENTION

The diagnostic golf club of the present invention comprises an internally powered and instrumented golf club with multiple strain gauges to measure, store, and provide an external display of quantitative variables of a golf club during a golf swing. A distinctive feature of the diagnostic golf club of the present invention is the use of a data storage memory device located within the shaft of the golf club, which is capable of receiving and storing data received from the plurality of strain gauges located on the club. The use of an internal memory device eliminates the need to use radio transmission hardware, data cables or wires to transfer data to an external data processing means. This also allows a golfer to swing the instrumented golf club without getting entangled in cables or wires, thus better allowing the golfer to replicate his or her natural golf swing.

In a preferred embodiment, swing data in the form of digitized signals are stored in a non-volatile flash buffer memory. The use of non-volatile memory insures that data is not lost if the system is turned off or in the event the battery fails. Because a ring buffer memory is used, it is still possible to replace older data with new data during successive cycles. The use of a ring buffer memory device provides for the creation of an instrumented golf club that is lightweight and free of cables or radio transmitters. Using a linear data capture approach, as taught by the prior art:, would require extensive amounts of memory, and would make it very difficult to provide such memory requirements completely internal to an instrumented golf club. It is through the use of the ring buffer memory that one is able to efficiently capture the desired swing data of interest, such as impact with a golf ball, and eliminate the need to provide internal memory to capture data unrelated to a golfer's swings.

Furthermore, since the ring buffer memory captures only the desired swing data of interest, data for multiple swings can be stored in the memory device of the instrumented golf club of the present invention until the user decides to upload the information to a computer unit for processing. Uploads can be effected via an interface mechanism located within the shaft. The interface provides for the electronic communication of data between the golf club and a computer unit. This provides increased flexibility and mobility to the user since the user is not required to stay within close physical proximity to the external data processing means.

In addition to the internal memory device, electronic circuitry consisting of a circuit board comprising a power control circuit, a signal conditioning circuit for the plurality of sensors and a serial communication circuit are located within the hollow interior of the shaft. Having these features incorporated into the circuit board allows downloading of high-level digital signals as well significantly reducing noise corruption and enables data to be stored indefinitely on the club. Locating the circuit board and components within the shaft also increases protection from shock loadings typically experienced upon ball impact when the circuitry is placed upon the golf club head.

In addition, incorporation of an internal power source for the instrumented golf club of the present invention is preferred for providing the benefits of flexibility and mobility. The internal power source can also be used to provide a proper weight balance, or swing weight, for the instrumented golf club, thereby closely approximating the golfer's own golf club. Although the internal power source can be placed in various locations within the instrumented golf club, in a preferred embodiment, a battery tube and one or more batteries are located within the shaft.

A preferred embodiment of the instrumented golf club system of the present invention comprises a first plurality of strain gauges located at an exterior tip end of the golf club shaft. A second plurality of strain gauges are located at an exterior butt end of the golf club shaft. In a preferred embodiment the plurality of strain gauges comprise two sets of three rosettes. Each rosette group containing gauges having a central bend gauge and two crossing shear gauges. The rosette groups arranged such that they form six individual Wheatstone bridges. Additionally, while it is preferable to locate individual rosette groups 120° from each other rosette group, those skilled in the pertinent art will recognize that distribution locations of the strain gauge rosette groups around the exterior perimeter of the golf club shaft is not critical and that distribution may be adjusted to achieve a desired placement distribution without departing from the scope and spirit of the present invention.

The system further comprises a circuit board positioned within the interior of the shaft comprising a memory circuit for storing the strain measurements, a power control circuit, a first signaling conditioning unit for the first plurality of strain gauges, a second signaling conditioning circuit for the second plurality of strain gauges, and a serial communication unit. The circuit board is connected via a first plurality of wires to the first plurality of strain gauges and via a second plurality of wires to the second plurality of strain gauges. A power source as previously described is positioned within the interior of the shaft for providing power to the circuit board, the first plurality of strain gauges and the second plurality of strain gauges.

Once the swing data has been obtained by the strain gauges and stored in the memory, a processor may be used to retrieve the stored memory from the instrumented golf club via an interface mechanism used to permit communication from the instrumented golf club to the processing unit. The retrieved data can then be used to provide a shaft flex profile for a golfer.

Furthermore, the strain and bend measurements stored by the instrumented golf club system of the present invention may be converted to a variety of measurements including axial force, transverse shear forces, bending moments, and torsion of the club during the swing. These measurements can also be used to generate a shaft flex profile for a golfer.

Through the use of an external data means, the instrumented golf club system enables quantitative swing data to be captured, transferred to the processing means, and then presented in any number of graphical, tabular or other visual formats to provide a golfer with meaningful feedback regarding the dynamics of a golf swing.

In addition, the instrumented golf club system. of the present invention can be used as a design tool for golf clubs including investigation of such variables as club head geometry, shaft dynamics, structural material behavior and type and location of weighting materials. As an example, the effect of different club head weighting locations can be measured for a wide range of golf swings to provide improved performance within this range of swings.

Accordingly, it is an object of the present invention to provide an instrumented golf club capable of measuring and storing data within the instrumented golf club without the use of an intermediate conduit such as external data transfer cables, wires or radio transmissions, thereby allowing greater flexibility and mobility to a user of the instrumented golf club.

It is a further object of the present invention to provide an instrumented golf club with non-volatile memory so that the memory is not lost if the club is turned off or the battery is removed.

It is a further object of the present invention to provide an instrumented golf club capable of converting a series of strain measurements to a series of force and bending moments in order to generate a shaft flex profile for a golfer.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
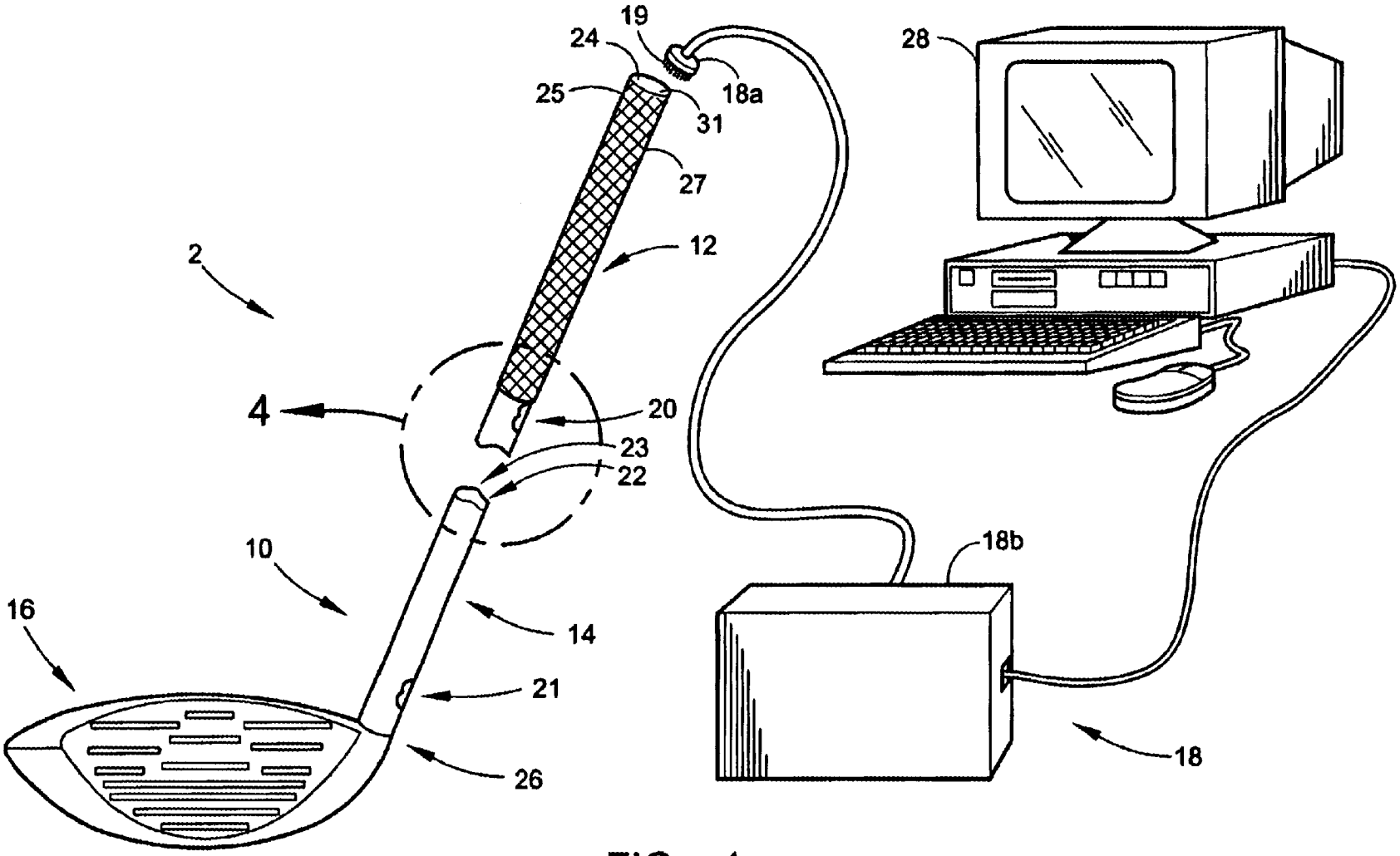
FIG. 1 is a perspective view of an instrumented golf club system in accordance with an embodiment of the present invention comprising an instrumented golf club, an associated interface mechanism and an external computing means.

FIG. 1 illustrates an instrumented golf club system 2 comprising an instrumented golf club 10, an interface mechanism 18 and a computing or data processing means 28. The instrumented golf club 10 comprises a grip 12, a shaft 14, a club head 16 a first plurality of strain gauges 20 located on the exterior 25 portion of the shaft 14 proximate the butt end 27, and a second plurality of strain gauges 21 located on the exterior 25 portion of the shaft 14 proximate the tip end 26, as further described below. Data measured by the first plurality of strain gauges 20 and the second plurality of strain gauges 21 is transferred from the instrumented golf club 10 to the computing means 28 via the interface mechanism 18. The interface mechanism 18 comprises a connection plug 18*a* and a serial interface device 18*b*. The connection plug 18*a* has a plurality of pins 19 for connection to a plurality of receptors (not shown) within the shaft for electronically communicating data from the instrumented golf club 10 to the data processing means 28.

When connected, the interface mechanism 18 provides external power to the instrumented golf club 10. The data that is collected by the instrumented golf club 10 is transferred to the computer means via the interface mechanism 18.

The golf club head 16 may be any type of conventional club head since the strain gauges 20 and 21 are located on the shaft 14. In a preferred embodiment, the club head 16 is composed of composite material such as disclosed. in U.S. Pat. No. 6,248,025, filed on Dec. 29, 1999, entitled Composite Golf Club Head And Method Of Manufacturing, and which pertinent parts are hereby incorporated by reference. However, those skilled in the pertinent art will recognize that other materials, such as titanium, titanium alloys, stainless steel, amorphous metals, persimmon and the like, may be used for the club head without departing from the scope and spirit of the present invention. Regardless of the material chosen for the club head, the golf club 10, when combined with the circuitry and electronic elements, should approximate the weight of a standard golf club.

The club head 16 is preferably a driver. However, the club head may be a fairway wood, an iron (1-iron through 9-iron), a wedge (lob, sand, pitching and approach) or a putter.

The shaft 14 may be anywhere from 35 inches for a wedge to 50 inches for a driver, and is preferably composed of a graphite material. However, the shaft may also be composed of steel titanium, or a bi-material. The shaft 14 has a wall 22 that defines a hollow interior 23. The shaft 14 has an interior surface 24 and an exterior surface 25. The shaft 14 has a tip end 26 in proximity to the club head 16 and a butt end 27, opposite the tip end 26. The shaft 14 also having an opening 31 to the hollow interior 24 located at the butt end 27. The shaft 14 generally tapers in its diameter from the butt end 27 to the tip end 26.

Figure 2:
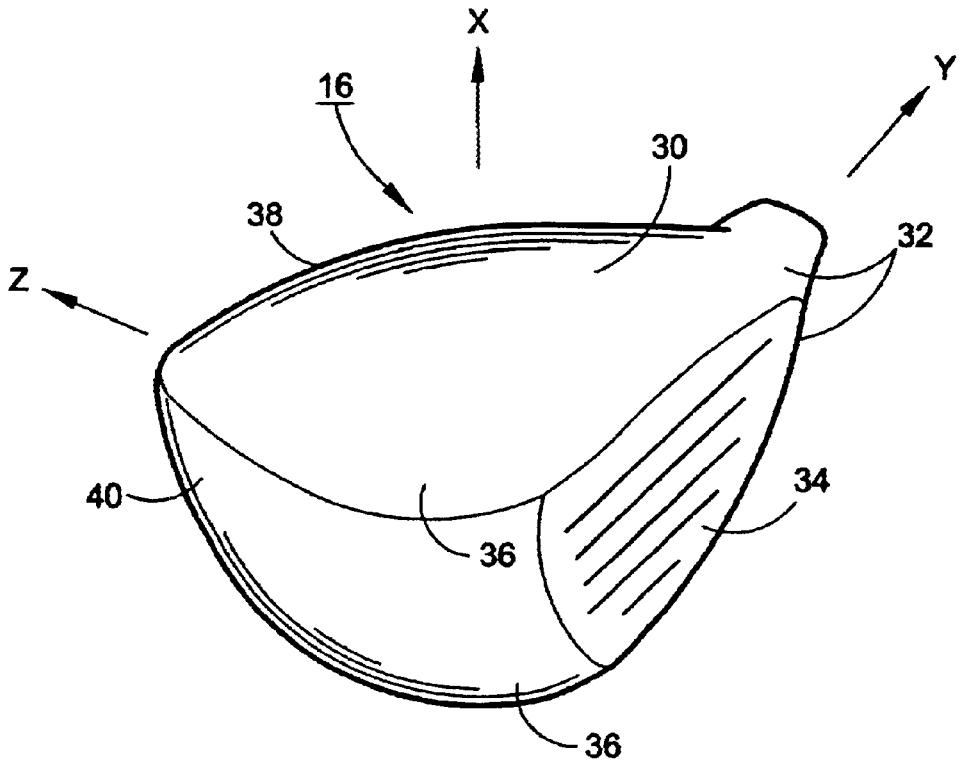
FIG. 2 is a top perspective view of an instrumented golf club head in accordance with an embodiment of the present invention illustrating a predetermined XYZ coordinate system.
Figure 3:
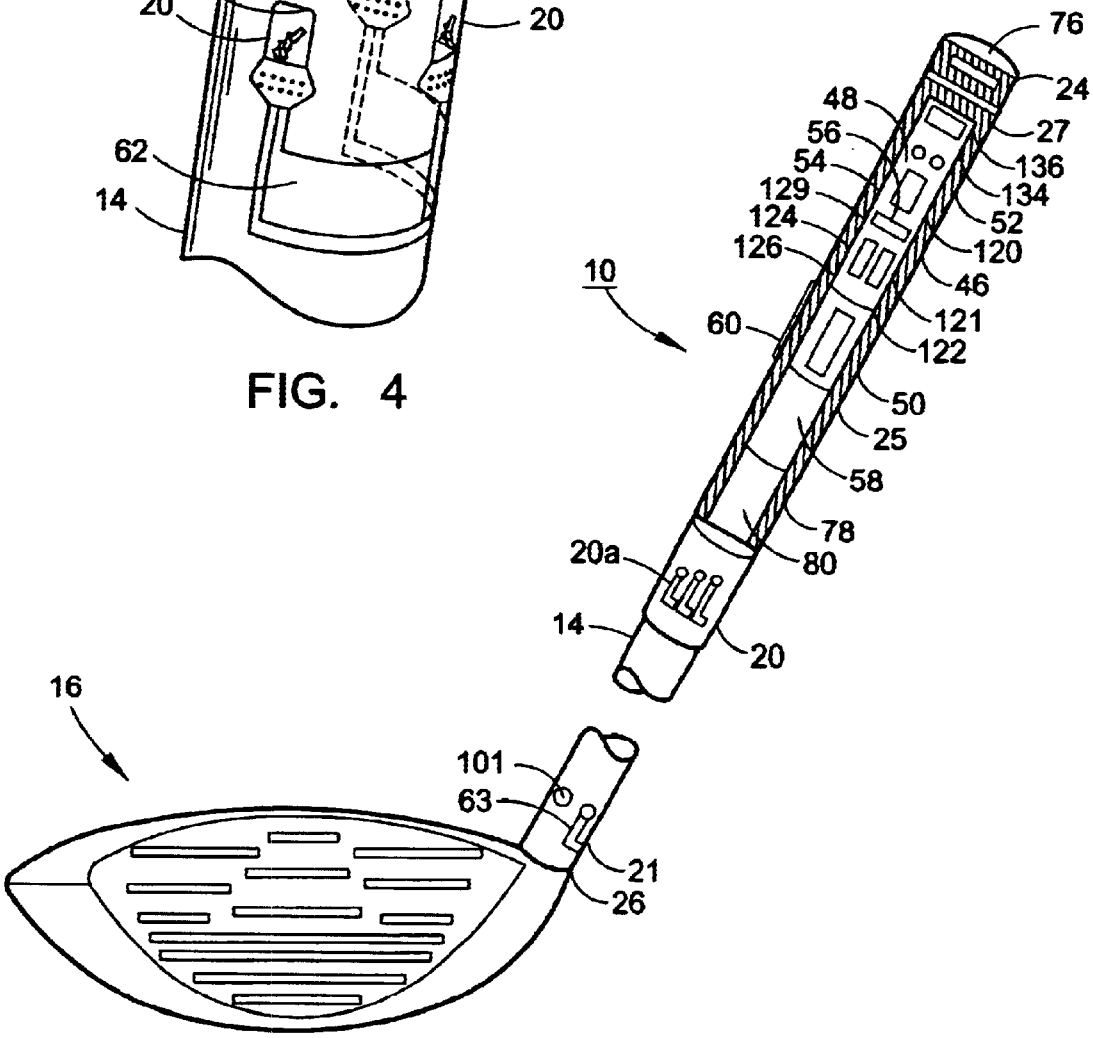
FIG. 3 is a perspective view of the shaft of the instrumented golf club in accordance with an embodiment of the present invention.

FIG. 2 is a top perspective view of the club head 16, comprising a top 30, a heel region 32, a face 34, a toe region 36, a rear region 38 and a ribbon 40. A right-hand coordinate system is used, and is illustrated by the designation of the X, Y and Z axes in FIG. 2. The X axis is oriented vertically (at address position) from a soleplate 54 (as shown in FIG. 3) to the top 30 of the club head 16. The Y axis is oriented horizontally (at address position) from the toe region 36 to the heel region 32. The Z axis is oriented horizontally (at address position) from the face 34 to the rear region 38.

Figure 2A:
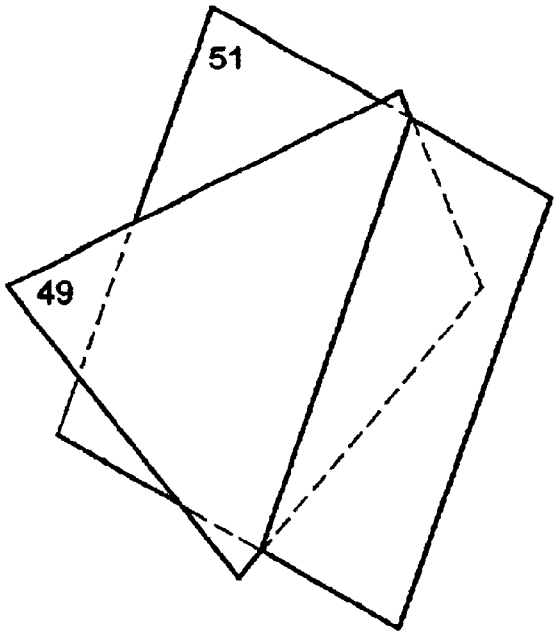
FIG. 2A is an illustration of shaft bending planes of the instrumented golf club in accordance with an embodiment of the present invention.

FIG. 2A is an illustration showing a first bending plane 49, and a second bending plane 51, wherein, the central axis of the shaft 14 (not shown) defines the intersection line of the first bending plane 49, and the second bending plane 51. The first bending plane 49 is aligned with the face 34 of the club head 16, and the second bending plane 51 is at a 90° angle, or orthogonal, to the first bending plane 49.

FIG. 3 illustrates the golf club shaft 14 of the instrumented golf club system 2 comprising a first plurality of strain gauges 20 consisting of a set of three rosette groups 20*a*, 20*b* and 20*c* (in phantom) located on a exterior 25 butt end 27 of the shaft 14 for providing axial and strain measurements during a golf swing. Additionally, a second plurality of strain gauges 21 consisting of a set of three rosette groups 21*a*, 21*b* and 21*c* (not shown) are shown located on the tip end 26 of the shaft 14 for providing axial and strain measurements during a golf swing.

A circuit board 46 is located within the hollow interior 24 of the shaft and is comprised of a memory circuit 48 for storing strain measurements, a power control circuit 50, a first signal conditioning circuit 52 for the first plurality of strain gauges 20, a second signal conditioning circuit 54 for the second plurality of strain gauges 21, and a serial communication circuit 56. In a preferred embodiment, the circuit board 46 is located approximately 10" down the shaft. However, one skilled in the art would understand that the location of the circuit board 46 is not critical and that placement could be varied to accommodate weight adjustments in different club types. Locating the electronics within the shaft helps to further protect the instrumentation from shock loadings that electronics mounted on the club head typically experience upon impact of the golf club with a golf ball.

An internal power source 58 is also positioned within the shaft to provide power supply to the circuit board 46 as well as to the first and second plurality of strain gauges 20 and 21 respectively.

An LED 60 is located on the exterior 25 of the shaft 14 to notify the user that the instrumented golf club system 2 is powered up and to signal upon each successive hit that a triggering event has occurred.

Figure 4:
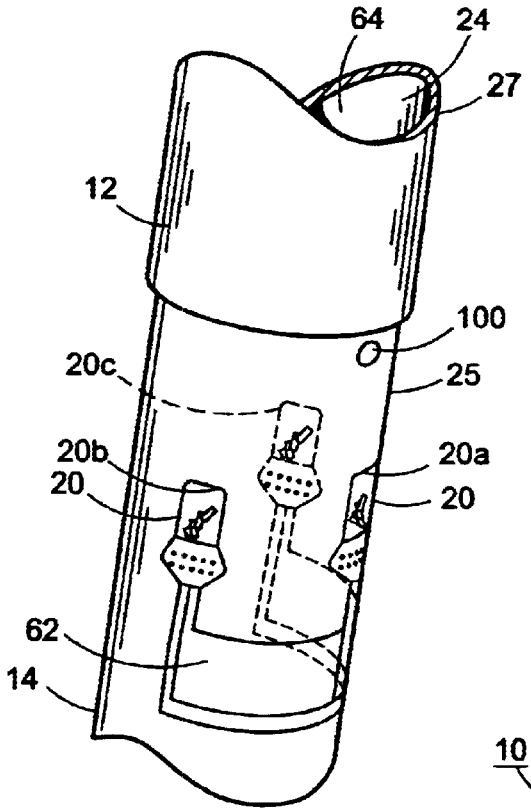
FIG. 4 is a view of a segment of the instrumented golf club shaft as defined by the area IV—IV in FIG. 1, and shows two strain gauges of the rosette group on a front surface and a strain gauge of the rosette group in phantom on a back surface.

FIG. 4 is a view of a segment of the instrumented golf club system 2, as defined by the area IV—IV in FIG. 1, and shows a first plurality of strain gauges 20. This first plurality of strain gauges being located on the exterior circumference of the shaft at a position proximate the butt end and comprising a set of three rosette groups. The first strain gauge group 20*a,* the second strain gauge group 20*b* and the third strain gauge group 20*c* (in phantom). Individual strain gauges are comprised of a triple element having a central axial gauge and a right and left crossing shear gauges such that when grouped the nine strain gauges form six Wheatstone bridges.

A first plurality of wires 62 is used to connect the first plurality of strain gauges 20 to the circuit board 46. At a triggering event such as the golfer's swing, each strain gauge input receives a signal referred to by a channel numbered (0–11). Each channel number referencing a recorded variable such as butt bend, butt shear, tip bend and tip shear for each strain gauge.

The first plurality of wires 62 connect the individual strain gauge groups 20*a,* 20*b* and 20*c* to the circuit board 46 by first connecting to the circuit board 46 and then running along the interior portion 24 of the golf club shaft 14, exiting the shaft 14 via an exit hole 100 located below the butt end 27 of the shaft 14 and connecting with the individual sets of strain gauge groups 20*a,* 20*b* and 20*c* located on the exterior 25 butt end 27 of the shaft 14.

The shaft 14 has an opening 64 at the butt end 27. The shaft 14 has a hollow compartment for placement of a power supply therein, electronic circuitry, sensors, and necessary wiring. A cap 76 is used to cover the hollow compartment of the shaft 14. In a preferred embodiment, the power supply is a battery tube 78 containing at least a first battery 80. The battery 80 provides internal power for the instrumented golf club 10. Preferably, a protective casing is located within the shaft 14 for placement of the battery 80.

The shaft electronic circuitry board 46, which may be one or two boards, includes the internal memory device 134, a non-volatile buffer memory, a main microprocessor 136, power control circuitry 120, signal conditioning circuitry 121 for the strain gauges in the butt end 27 of the shaft 14, signal conditioning circuitry 122 for the strain gauges in the tip end 26 of the shaft 14, serial communication circuitry 124, filter circuitry 126 for the strain gauges, and an analog to digital converter circuitry 128. The shaft electronic circuitry board 46 is a typical power circuitry board.

The placement of all of the electronics in the shaft 14, as opposed to the club head 16, allows for the use of multiple club heads 16 in order to analyze a golfer's swing for different clubs. Further, the components in the shaft 14 are modular, and thus are easily replaceable if damaged. Such replacement is performed via the opening.

A second plurality of strain gauges is also located at the tip end 26 of the golf club shaft 14. This second plurality of strain gauges 21 being located on the exterior circumference of the tip end of the shaft comprised of a set of three rosette groups being a mirror image of the strain gauges located at the butt end of the shaft. The first strain gauge group 21*a,* the second strain gauge group 21*b* and the third strain gauge group 21*c*. The individual strain gauges comprised of a triple element having a central axial gauge and right and left crossing shear gauges such that the rosette groups form six Wheatstone bridges.

A second plurality of wires 63 is used to connect this second plurality of strain gauges 21 to the circuit board 46. At a triggering event such as a golfer's swing, individual strain gauge inputs receive a signal referred to by a channel numbered (0–11). Each channel number referencing a recorded variable such as butt bend, butt shear, tip bend and tip shear for each strain gauge pair.

A second plurality of wires 63 connects the strain gauge groups 21*a*, 21*b* and 21*c* to the circuit board 46 by first connecting to the circuit board 46 and then running along the interior 24 portion of the golf club shaft 14, exiting the interior 24 of the shaft 14 via a second exit hole 101 located below the butt end 27 of the shaft 14 and running along the length of the exterior 25 of the shaft 14 to connect with the second plurality of strain gauge sets 21*a*, 21*b* and 21*c* located on the tip end 26 of the shaft. This second plurality of wires 63 connecting the second plurality of strain gauges 21 from the tip end 26 of the golf club shaft 14 are preferably glued to the exterior of the golf club shaft 14, however the second plurality of wires 63 may also be affixed to the shaft 14 by any other means including mechanical, that are commonly used in the art.

DETAILED DESCRIPTION OF A PREFERRED OPERATION

Figure 5:
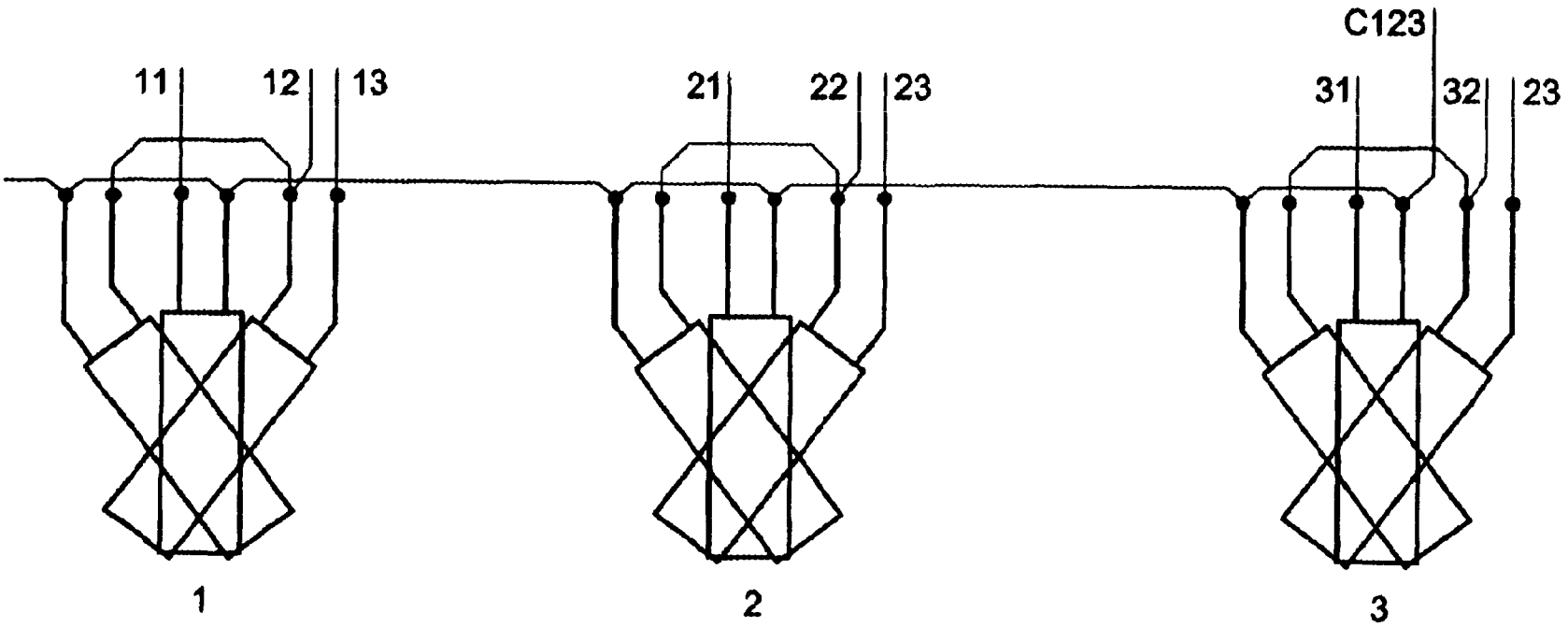
FIG. 5 is a view of the triplet strain gauge elements as arranged about the exterior circumference of the shaft of the instrumented golf club in tip and butt ends.
Figures 6, 7:
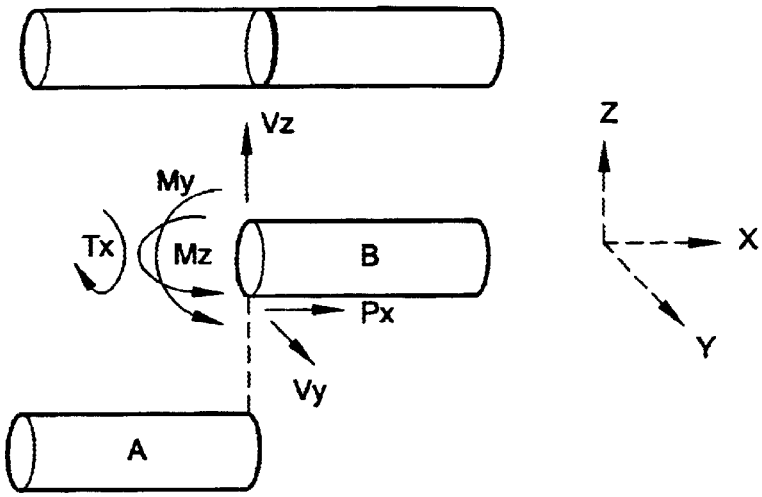
FIG. 6 is an illustration of the forces acting upon a typical strain gauge element in the instrumented golf club of the present invention.
FIG. 7 is a chart illustrating the relationship between the strain, stiffness and force/moments for the data collected from the strain gauges in accordance with an embodiment of the present invention.

FIG. 5 is a view of an individual strain gauge group 20*a* as arranged about the circumference of the exterior of the shaft 14 of the instrumented golf club 10 of the present invention. Six independent strain gauge elements are needed to make essential measurements in order to calculate the six independent forces and moments. These six individual elements are axial force (Px), transverse shear forces (Vy) and (Vz), bending moments (My) and (Mz) and torsion (Tx). FIG. 6 is a view of these forces acting upon a typical strain gauge of the present invention.

Data obtained from the independent forces and moments acting on the shaft at the tip end 26 and butt end 27 are computed from the strain data received via the sets of strain gauges and from the information obtained relative to the shaft stiffness matrix at each location. These stiffness matrices are obtained using experimental or analytical techniques well known in the art. Once obtained, the values are entered into the computer program and the data is converted from strains and bends to loads and moments. The relationship between the strain, stiffness and force/moment is illustrated in FIG. 7.

Figure 8A:
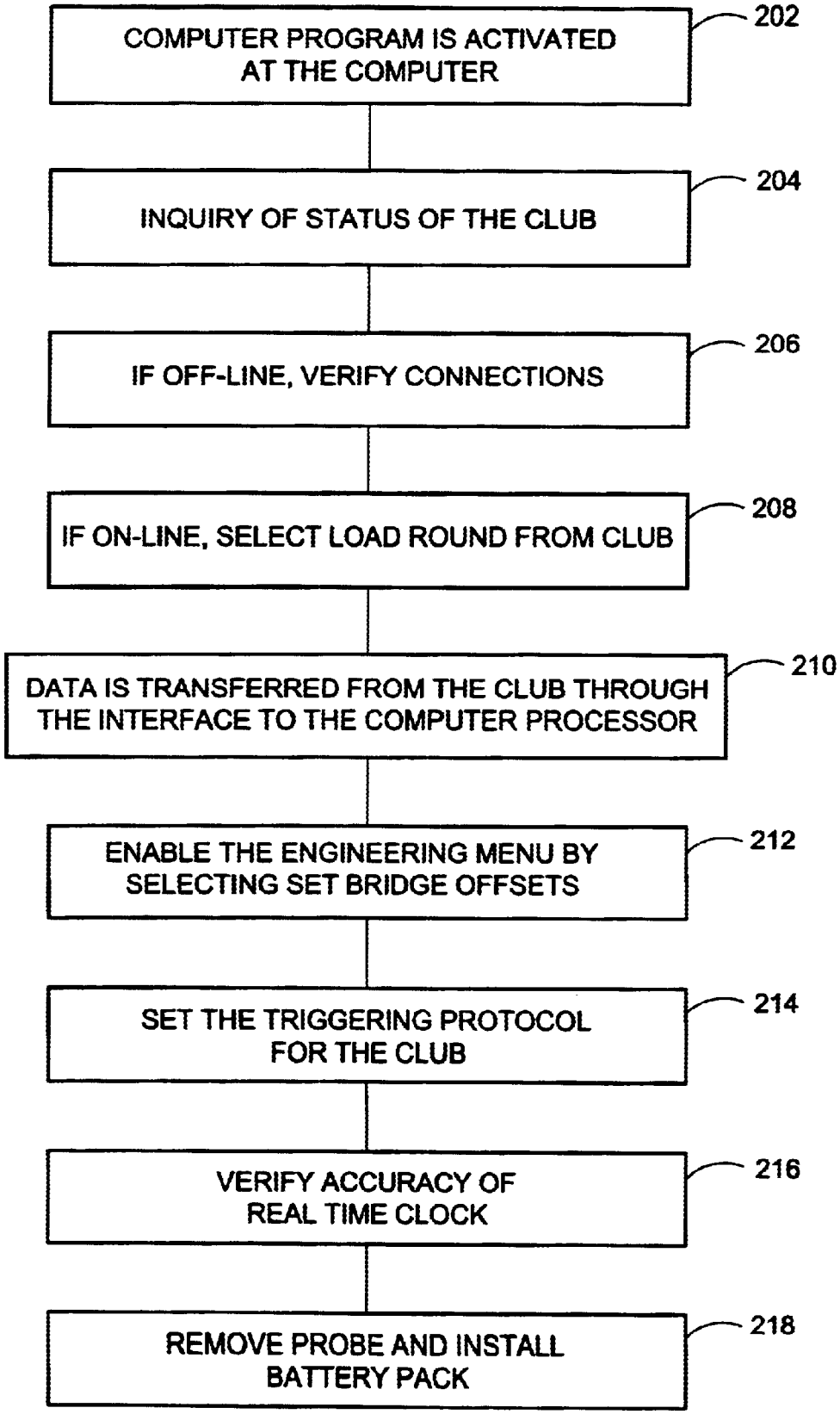
FIG. 8 (8A, and 8B) shows a flow chart illustrating the operational steps of the instrumented golf club system in accordance with an embodiment of the present invention.
Figure 8B:
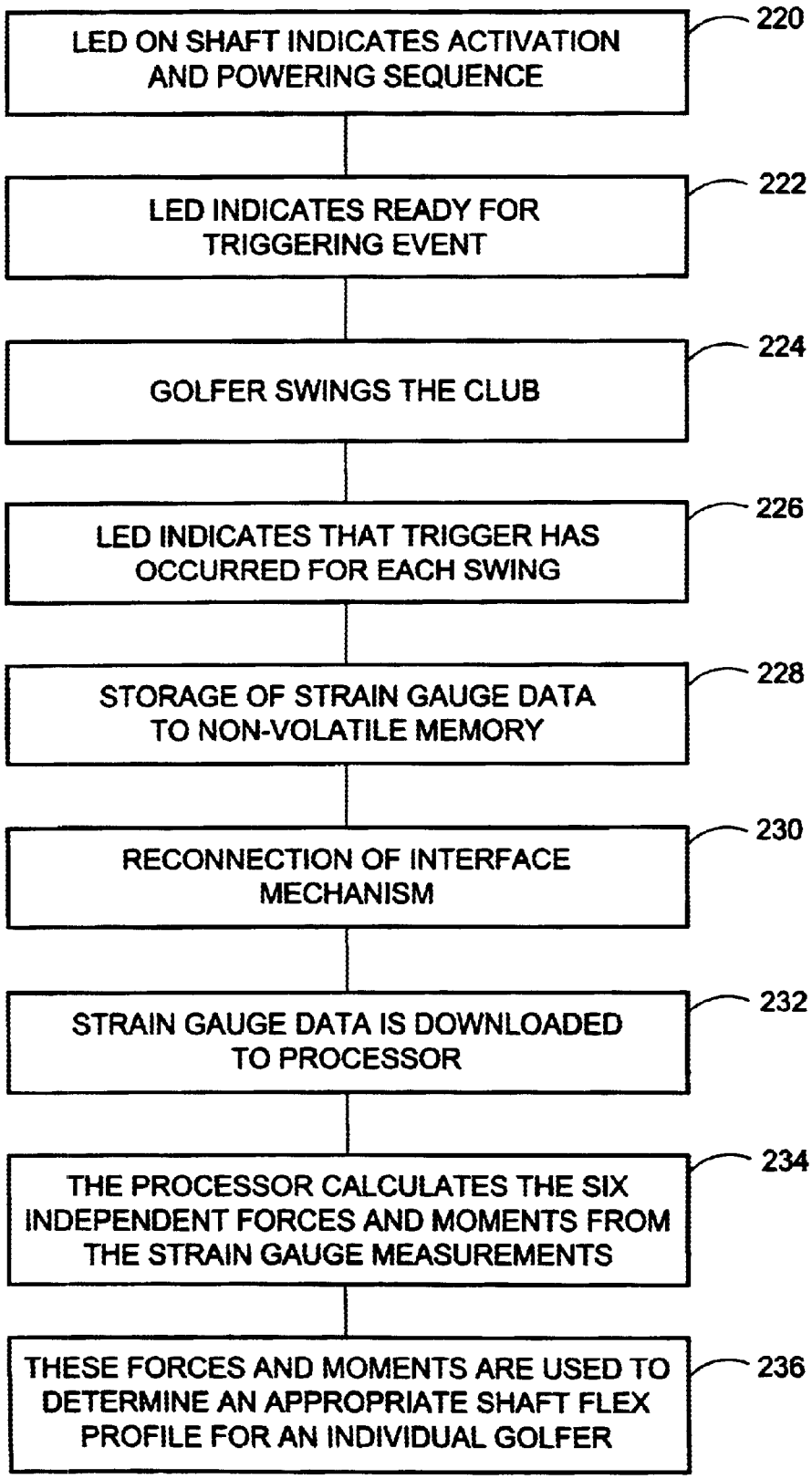

FIG. 8 is a flow chart illustrating the steps of operation of the instrumented golf club (as shown in FIG. 1) of the present invention. The entire flow chart is shown in two sections, FIGS. 8A and 8B. Prior to initial use it is necessary to load the programming software into the instrumented golf club. First, at step 202, computer program is activated at the computer. The club is then connected to the computer via a probe and at step 204 inquiry of the club status is displayed. In the event, as in step 206, the display indicates that communication between the club and the computer is off-line, the user should verify the connection of the interface mechanism between club and computer. When the status indicates as in step 208 that the communication is on-line, the user should select load round from the club.

At step 210, data is then transferred from the club through the interface to the computer processor. Once the data is transferred, at step 212 the engineering menu may be enabled by typing CTR-ALT-E.

The user will then be asked at step 214 to set the triggering protocol for the club. At step 216 verification of the real time clock is performed and at step 218, the probe is removed from the club and installation of the battery pack is performed.

In FIG. 8B once the probe has been removed and the battery pack installed, at step 220 an LED located on the shaft 14 indicates that the swing analysis problem has been activated and that the club has been powered up for use. At step 222, the LED indicates that the program is ready for triggering.

At step 224, the golfer swings the club. The swinging of the club indicates to the strain gauges that a triggering event has occurred and at step 226 the LED will display the occurrence of this triggering event.

At step 228, the data received by the strain gauges with respect to the bending and shear moments will be stored in a non-volatile ROM memory.

At step 230, the user may reconnect the interface mechanism between the instrumented golf club and the computer in order to facilitate the download of information from the club to the computer for processing. At step 232, data from both the first plurality of strain gauges 20 and the second plurality of strain gauges 21 is downloaded to the processing unit.

The processor at step 234 then calculates the six independent forces and moments from the strain gauge measurements. The forces and moments are then used to determine an appropriate shaft flex profile for an individual golfer at step 236.

Figure 9:
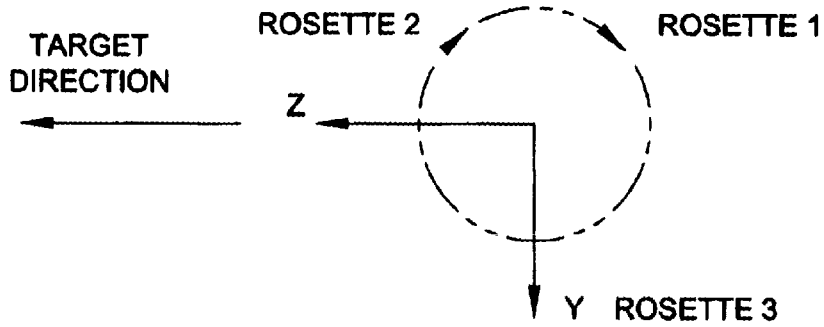
FIG. 9 displays sample initial values for all strain gauges.

FIG. 9 comprises sample initial data values when the instrumented golf club 10 is in a ready state, before the triggering event of the golf swing and impact with the golf ball has occurred. The top of FIG. 9 indicates the values of the calibration constants at various locations along the shaft used in calculating the values for the data obtained during the collection of the sample data. The first twelve columns indicate the values of the twelve strain gauge channels received from the sets of strain gauges located either on the tip end or the butt end of the club. The next six columns indicate the calculated values of the six independent forces and moments for the strain gauges located on the butt end of the shaft and the last six columns indicate the calculated values of the six independent forces and moments for the strain gauges located on the tip end of the shaft.

Figure 10:
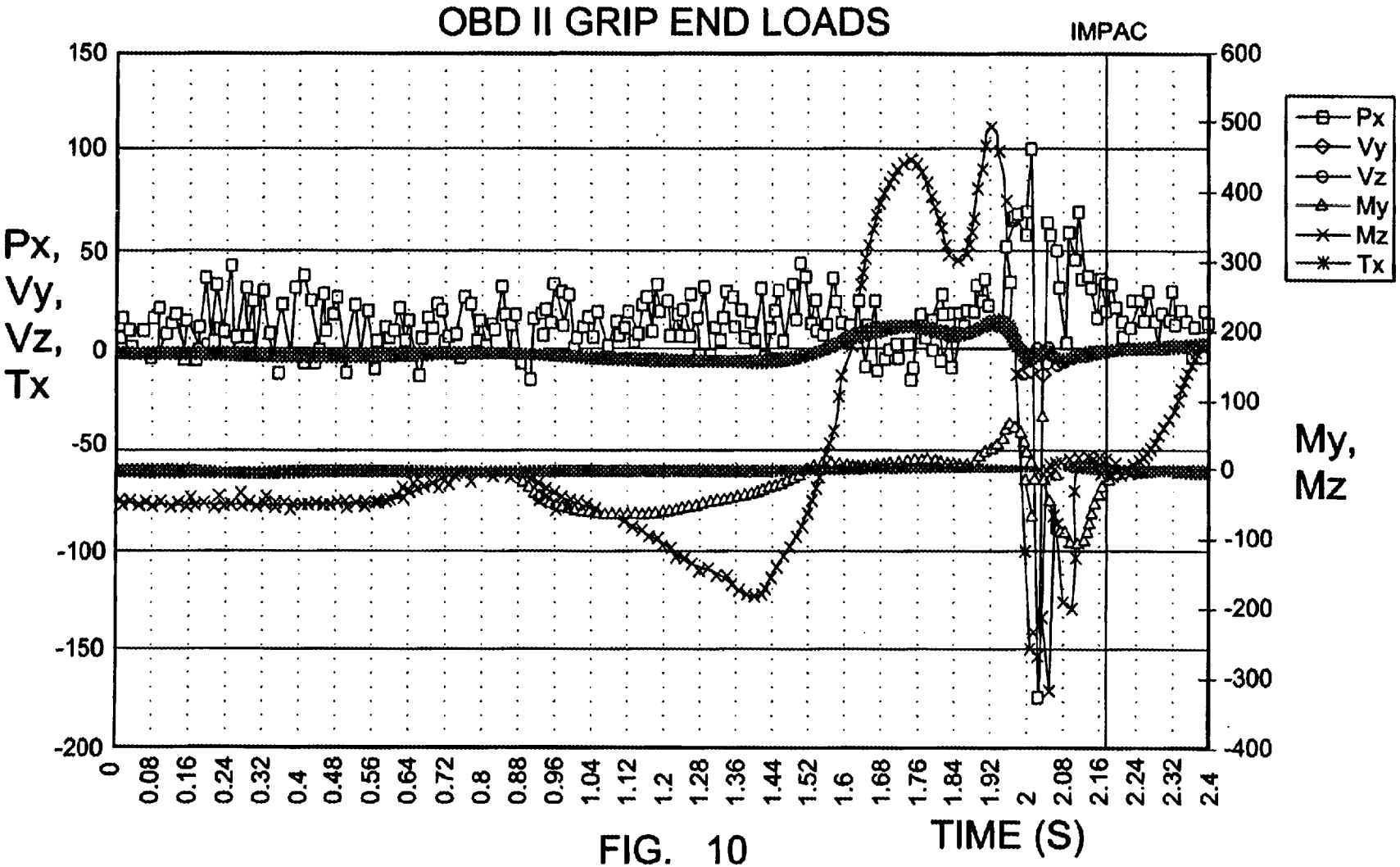
FIG. 10 is a graphical presentation of data recorded by the strain gauges located at the butt end of the shaft of the instrumented golf club during a typical golf swing.
Figure 11:
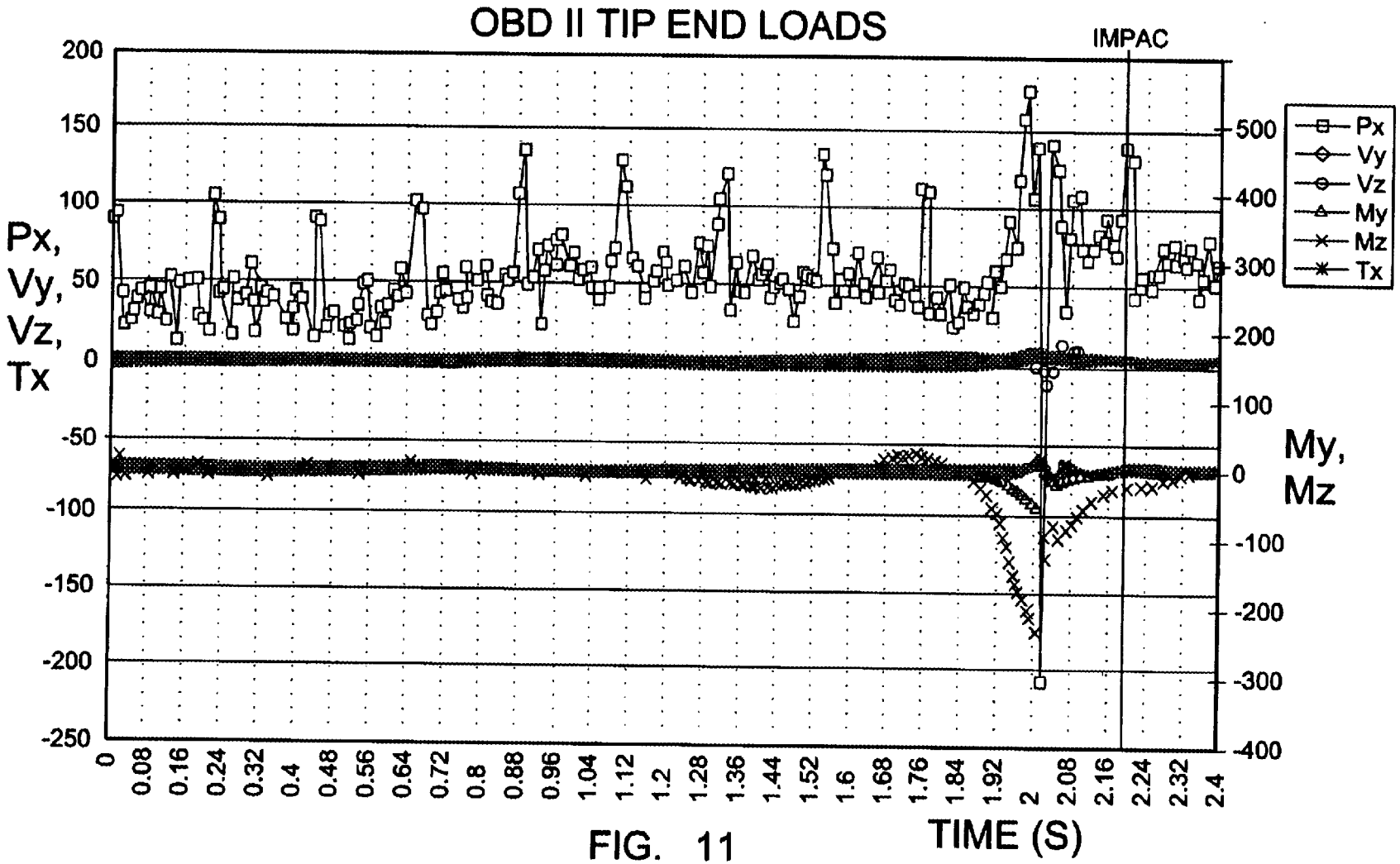
FIG. 11 is a graphical presentation of data recorded by the strain gauges located at the tip end of the shaft of the instrumented golf club during a typical golf swing.

FIG. 10 and FIG. 11 illustrate sample displays of data collected from a portion of a typical golf swing of the instrumented golf club 10 illustrating the calculated forces and moments both before impact and after impact on the butt end 27 of the shaft 14 (FIG. 10) and tip end 26 of the shaft 14 (FIG. 11). The data is collected from the channels and then converted to values in terms of forces and moments. These forces and moments are displayed in graphical representation and identified as axial force (Px), bending moments (Mz) and (My), transverse shear forces (Vy) and (Vz) and torsion (Tx).

Once the raw data is collected, the information can be used to generate information to allow the proper shaft flex to be determined for an individual golfer.

It is understood that a person of ordinary skill in the art of computer programming can create a program that will take the raw data, and manipulate the data such that the characteristics of the golf club during the golfer's swing can be pictorially displayed in a more useful, informative and user friendly manner. This will provide the golfer with useful feedback beyond just the physically measured numerical data.

A similar procedure can be used in golf club design, for example, to improve the club head geometry, select materials for the club head or shaft, or help locate weighting material within the club head. Furthermore, various tabular, graphical, or other visual formats can be used to display this raw data, including synchronization of the data with a camera for highlighting the golfer's swing area of maximum club head acceleration, hand rotation and shaft bending stress.

In addition, data from an individual golf swing or golf club design can be plotted against golf ball launch data associated with that golf swing or design, so that changes can be suggested to improve distance and accuracy.

Further, the data may be used to design a golf club that is appropriate for a specific type of golfer, or even for an individual golfer. Various shafts may be utilized in the testing to determine which type of shaft may be appropriate for a specific type of golfer. The shafts may vary in length, thickness, flexibility, and the like. One example would have a golfer swing each type of shaft to determine which one was appropriate for that specific type of golfer.

Various club heads also may be utilized in the testing to determine which type of club head may be appropriate for a specific type of golfer. The club heads may vary in material composition, mass, weight placement (e.g. center of gravity purposes), and the like. As above, one example would have a golfer swing each type of club head to determine which one was appropriate for that specific type of golfer. Alternatively, the data may be used to determine an appropriate club head for a specific type of golfer.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A diagnostic golf club system comprising:

a diagnostic golf club comprising a shaft and a club head, the shaft attached to the club head, a plurality of strain gauges attached to the shaft, each of the plurality of strain gauges capable of measuring data related to the golf club during a golf swing, and an internal memory device capable of receiving and storing data from the plurality of strain gauges, the internal memory device including a non-volatile flash buffer memory disposed within the shaft;

a computer for processing the data from the internal memory device, the computer being separate from the golf club; and an interface mechanism capable of providing communication between the diagnostic golf club and the computer, the interface mechanism being removably coupled to the golf club, wherein the non-volatile flash buffer memory is capable of storing data for multiple swings of the diagnostic golf club until the data is uploaded to the computer via the interface means.

2. The system according to claim 1 wherein the shaft further comprises a circuit board positioned within a hollow interior of the shaft, the circuit board comprising a power control circuit, a signal conditioning circuit for the plurality of strain gauges, and a serial communication circuit.

3. The system according to claim 1 wherein the golf club is selected from the group consisting of a driver, a fairway wood, an iron and a putter.

4. The system according to claim 1 wherein the golf club head is composed of a material selected from the group consisting of plies of pre-preg material, titanium, stainless steel, bi-metal material and persimmon.

5. The system according to claim 1 wherein the interface mechanism comprises a connection plug and a serial interface device, the connection plug having a plurality of pins for connection to a plurality of receptors within the shaft for electronically communicating data from the diagnostic golf club to the computer.

6. The system according to claim 1 wherein the non-volatile flash buffer memory is a ring buffer memory.

7. A system for determining the shaft flex profile of a golfer, the system comprising:

a golf club including a club head and a shaft attached to the club head, the shaft having a wall defining a hollow interior, the wall having an exterior surface and an interior surface, the shaft having a tip end in proximity to the golf club head and a butt end opposite thereto, the shaft having an opening to the hollow interior at the butt end;

a first plurality of strain gauges for providing strain measurements during a golf swing mounted onto exterior surface at the tip end of the shaft, and a second plurality of strain gauges for providing strain measurements during a golf swing mounted on the exterior surface at the butt end of the shaft;

a circuit board positioned within the hollow interior of the shaft, the circuit board comprising a memory circuit for storing the strain measurements, a power control circuit a first signal conditioning circuit for the first plurality of strain gauges, a second signal conditioning circuit for the second plurality of strain gauges, and a serial communication circuit, the memory circuit including a non-volatile flash buffer memory;

a power means positioned within the hollow interior of the shaft for providing power to the circuit board, the first plurality of strain gauges and the second plurality of strain gauges;

a first plurality of wires connecting the first plurality of strain gauges to the circuit board, and a second plurality of wires connecting the second plurality of strain gauges to the circuit board;

a grip mounted on the butt end of the shaft;

a processor for processing the strain measurements from the first plurality of strain gauges and the second plurality of strain gauges to provide a shaft flex profile for the golfer, the processor being separate from the golf club head and shaft; and an interface mechanism for transferring the measurement data from the memory circuit to the processor, wherein the non-volatile flash buffer memory is capable of storing data for multiple swings of the golf club until the data is uploaded to the processor via the interface means.

8. The system according to claim 7 wherein the first plurality of strain gauges consists of nine strain gauges, and the second plurality of strain gauges consists of nine strain gauges.

9. The system according to claim 8 wherein the nine strain gauges of the first plurality of strain gauges are paired, with each pair approximately one-hundred twenty degrees apart from any other pair on the shaft, and the nine strain gauges of the second plurality of strain gauges are paired, with each pair approximately one-hundred twenty degrees apart from any other pair on the shaft.

10. The system according to claim 7 wherein the golf club is selected from the group consisting of a driver, a fairway wood, an iron and a putter.

11. The system according to claim 7 wherein the golf club head is composed of a material selected from the group consisting of plies of pre-preg material, titanium, stainless steel, bi-metal material and persimmon.

12. The system according to claim 7 wherein the shaft is composed of a material selected from the group consisting of graphite, steel, titanium and a metal graphite composite.

13. The system according to claim 7 wherein the power source is a battery, and the shaft further comprises a protective casing for placement of the battery therein.

14. A system for determining the shaft flex profile of a golfer, the system comprising:

a golf club including a club head and a shaft attached to the club head;

means for measuring the swing loads of a golfer during a golf swing, the load measuring means disposed on die shaft;

means for storing swing load measurements generated by the load measuring means, the storig means including a non-volatile flash buffer memory disposed in the shaft;

means for generating a shaft flex profile for a golfer from the swing load measurements, the generating means being located separate from the golf club; and means for transferring the swing load measurements to the generating means, wherein the non-volatile flash buffer memory is capable of storing multiple swing load measurements indicative of multiple golf swing until the measurements are transferred by the transferring means to the generating means.

15. A system for determining the shaft flex profile of a golfer, the system comprising:

a golf club including a club head and a shaft attached to the club head;

means for measuring the axial force on a shaft during a golf swing, the axial force measuring means disposed on the shaft;

means for measuring the transverse shear forces on a shaft during a golf swing, the transverse shear force measuring means disposed on the shaft;

means for measuring the bending moments on a shaft during a golf swing, the bending moments measuring means disposed on the shaft;

means for measuring the torsion on a shaft during a golf swing, the torsion measuring means disposed on the shaft;

means for storing a set of measurements generated by the axial force measuring means, the transverse shear force measuring means, the bending moments measuring means, and the torsion measuring means, the storing means including a non-volatile flash buffer memory disposed in the shaft;

means for generating a shaft flex profile for a golfer from the measurements, the generating means being separate from the golf club; and means for transferring the measurements to the generating means, wherein the non-volatile flash buffer memory is capable of storing multiple sets of measurements indicative of multiple golf swings until the measurements are unloaded by the transferring means to the generating means.

16. A method for determining a shaft flex profile for an individual golfer, the method comprising:

activating a golf club having an on-board diagnostics comprising a plurality of strain gauges mounted on an exterior surface of a shaft of the golf club and a non-volatile flash buffer memory located within the shaft;

swinging the golf club;

measuring a plurality of strains on the shaft;

storing the strain measurements in the non-volatile flash buffer memory, the non-volatile flash buffer memory storing strain measurements for multiple swings of the golf club;

downloading the strain measurements to a processor separate from the golf club; calculating a plurality of forces and moments from the swing; and determining the shaft flex profile for the individual golfer based on the calculations.

17. The method according to claim 16 wherein swinging the golf club comprises swinging and striking a golf ball.

* * * * *